US007117615B2

(12) United States Patent
Gerber

(10) Patent No.: US 7,117,615 B2
(45) Date of Patent: Oct. 10, 2006

(54) SHOE WITH REVERSIBLE UPPER

(75) Inventor: Marni L. Gerber, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 258 days.

(21) Appl. No.: 10/855,772

(22) Filed: May 28, 2004

(65) Prior Publication Data

US 2005/0262738 A1 Dec. 1, 2005

(51) Int. Cl.
*A43B 3/24* (2006.01)

(52) U.S. Cl. ..... 36/101; 36/11.5

(58) Field of Classification Search ..... 36/101, 36/100, 11.5, 115
See application file for complete search history.

(56) References Cited

U.S. PATENT DOCUMENTS 2,409,813 A 12/1946 Timson
2,444,640 A * 7/1948 Epstein ..... 501/19
2,493,154 A * 1/1950 Mavrakis ..... 36/101
4,267,649 A * 5/1981 Smith ..... 36/101
4,535,554 A * 8/1985 De Obaldia B. ..... 36/113
5,852,885 A * 12/1998 Ferniani ..... 36/11.5
6,792,696 B1 * 9/2004 Berg et al. ..... 36/11.5
6,931,766 B1 * 8/2005 Greene ..... 36/101
2002/0124434 A1 * 9/2002 Hsin et al. ..... 36/11.5

* cited by examiner

*Primary Examiner*—Ted Kavanaugh
(74) *Attorney, Agent, or Firm*—Banner & Witcoff, Ltd.

(57) ABSTRACT

A shoe includes a reversible upper portion. Each shoe in the pair includes a sole and a reversible upper. An attachment system enables the uppers to be removably attachable to the soles in different exposure orientations. The coupling system may include a mating elements on the upper and the sole. The mating elements may be keyed such that one or more mating elements on the upper may only mate with selected respective elements on the sole. This system enables the reversal of the uppers to expose different aesthetic appearances if the uppers have different aesthetics on the top and bottom. As the uppers are preferably designed to be asymmetrical, reversing the uppers is accomplished by detaching and moving the upper from one sole to the other sole, inverting it to expose the other side, and attaching it to the other sole. This is particularly useful for a pair of sandals.

16 Claims, 6 Drawing Sheets

SHOE WITH REVERSIBLE UPPER

BACKGROUND OF THE INVENTION

This invention relates to an article of footwear, such as a sandal or other shoe, having a reversible upper system.

DESCRIPTION OF BACKGROUND ART

Most shoes include an upper and a sole. The upper is commonly fixedly attached to the sole to help retain the foot of the user to the shoe. Such shoe uppers commonly present only a single outward appearance. This limits the potential outward appearances of a shoe. Further, with a single upper presentation system, strains, scratches, and other blemishes may cause the shoe to have an unsightly appearance and render it inappropriate or undesirable for wear. A shoe having a reversible upper system is disclosed in U.S. Pat. No. 2,409,813. However, such a reversibility system has a significant drawback in that it inherently results in an undesirable fit, and exposes ground-contacting sole material directly to the foot of the user.

BRIEF SUMMARY OF THE INVENTION

The following presents a simplified summary of the invention in order to provide a better understanding of some aspects of the invention. It is not intended to be an extensive overview of the invention or aspects thereof. Nor is it intended to identify or define critical elements of the invention. This summary merely describes some aspects of the invention in a simplified manner as a prelude to the detailed description hereinafter.

It is an aspect of the invention to provide a pair of shoes having a set of uppers that are removably attachable to sole units. The uppers are reversible such that it will have a first appearance on one sole and a different appearance when inverted and coupled to the other sole. This provides the user with multiple fashion choices for the presentation of his or her shoes.

An aspect of the present invention is directed to a pair of shoes including a left sole, a right sole, and first and second reversible uppers. The uppers are removably detachable from the left and right soles. Each of the uppers is longitudinally asymmetric.

Another aspect of the present invention is directed to a pair of shoes including a left sole, a right sole, and first and second uppers each removably detachable from the left and right soles. The pair of shoes further includes a keyed upper-to-sole coupling system for coupling the uppers to the soles such that the first upper can be coupled to the left sole in a first exposed orientation and coupled to the right sole in a second exposed orientation opposite from the first exposed orientation, and wherein the second upper can be coupled to the right sole in a first exposed orientation and coupled to the left sole in a second exposed orientation opposite from the first exposed orientation.

Another aspect of the present invention is directed to a pair of uppers that are movably attachable to a pair of soles. The uppers include keyed mating coupling elements such that the first upper is attachable to a first sole only in a single exposed orientation and is attachable to the second sole only in a different exposed orientation, and the second upper is attachable to the second sole only in a single exposed orientation and is attachable to the first sole only in a different exposed orientation.

The various advantages and features of novelty that characterize the present invention are pointed out with particularity in the claims. To gain an improved understanding of the advantages and features of novelty that characterize the present invention, however, reference should be made to the enclosed detailed description and accompanying drawings which describe and illustrate various embodiments of the invention.

DETAILED DESCRIPTION OF THE INVENTION

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

Figure 1:
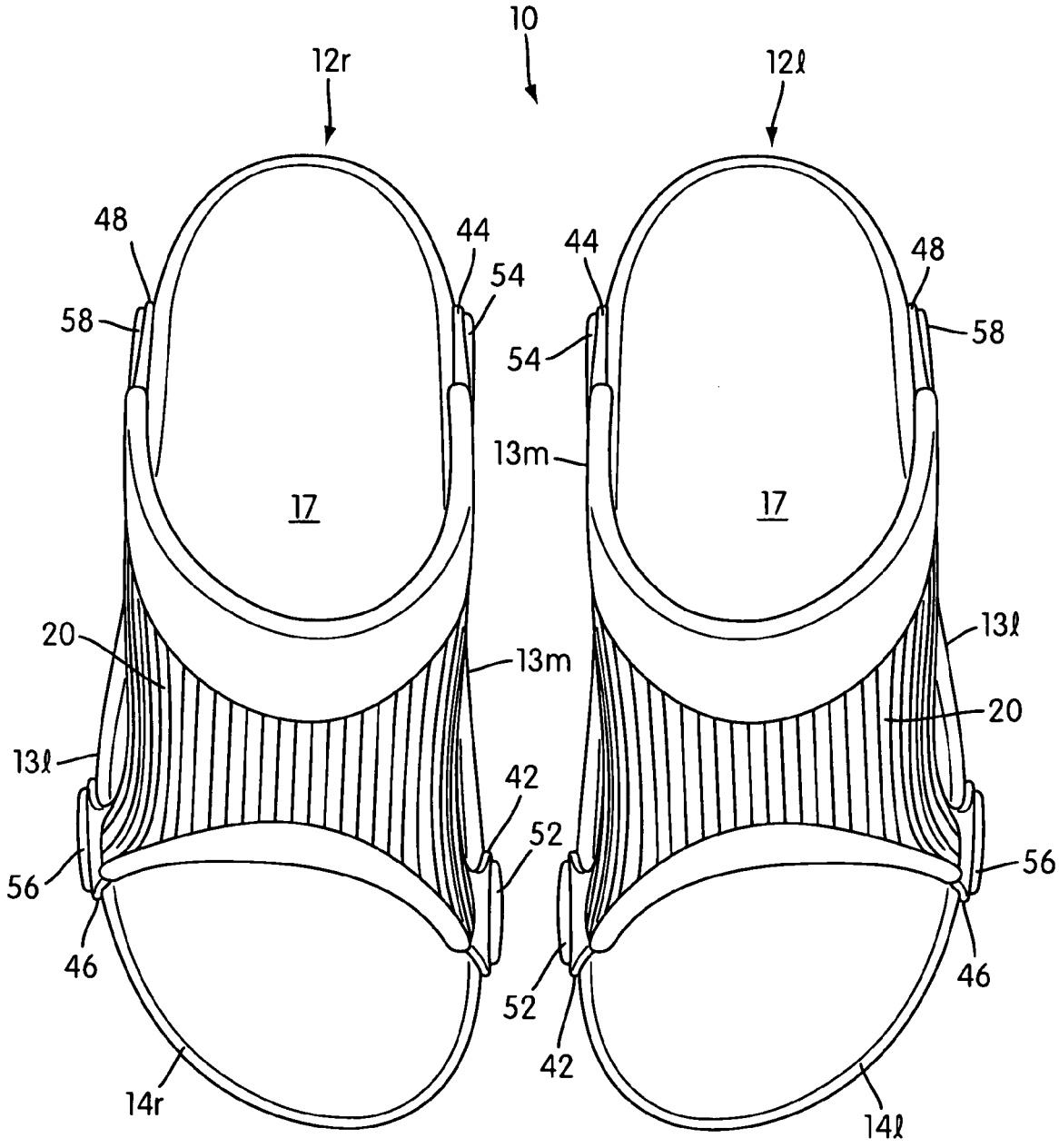
FIG. 1 is a top view of a pair of shoes having upper portions being attached to the soles in a first configuration in accordance with the present invention.
Figure 3A:
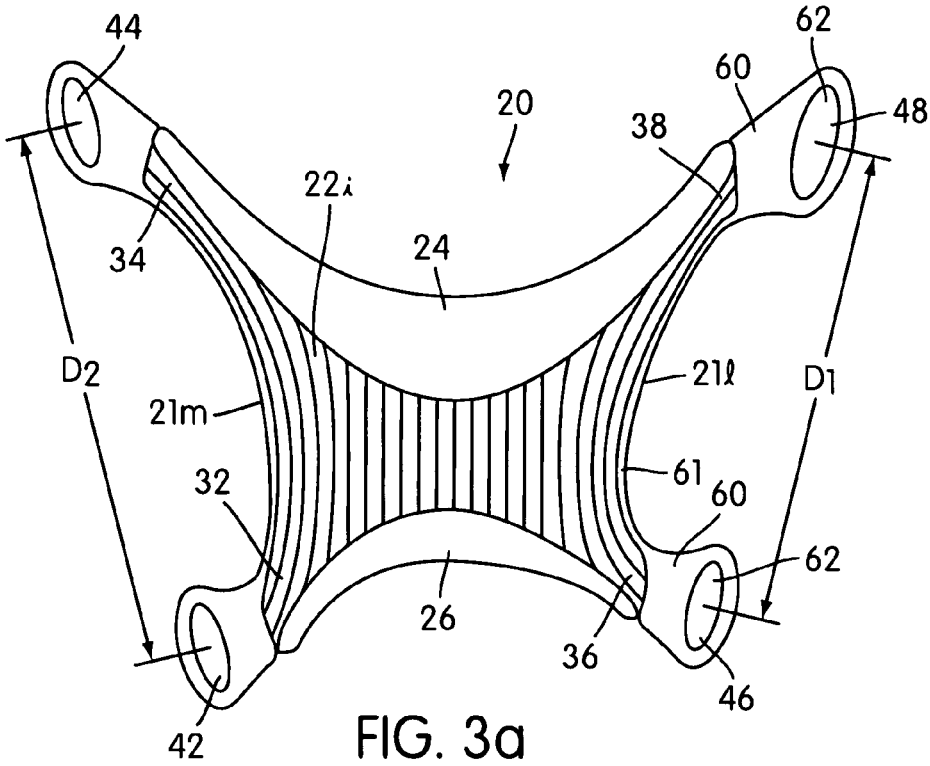
FIGS. 3A and 3B are top and bottom views respectively of an exemplary upper in accordance with the present invention.
Figure 3B:
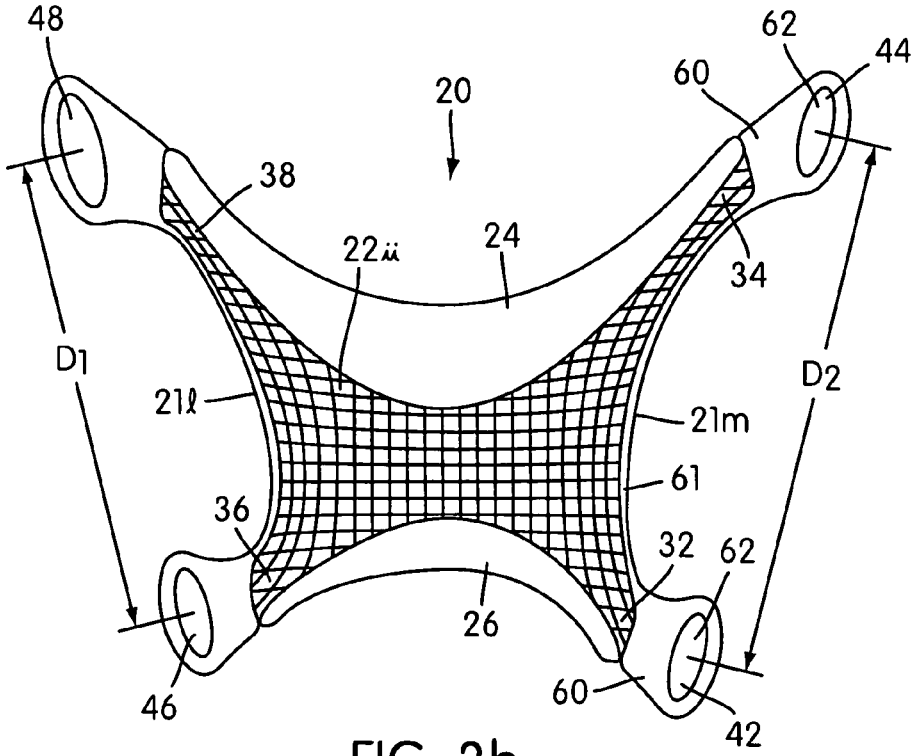
Figure 4:
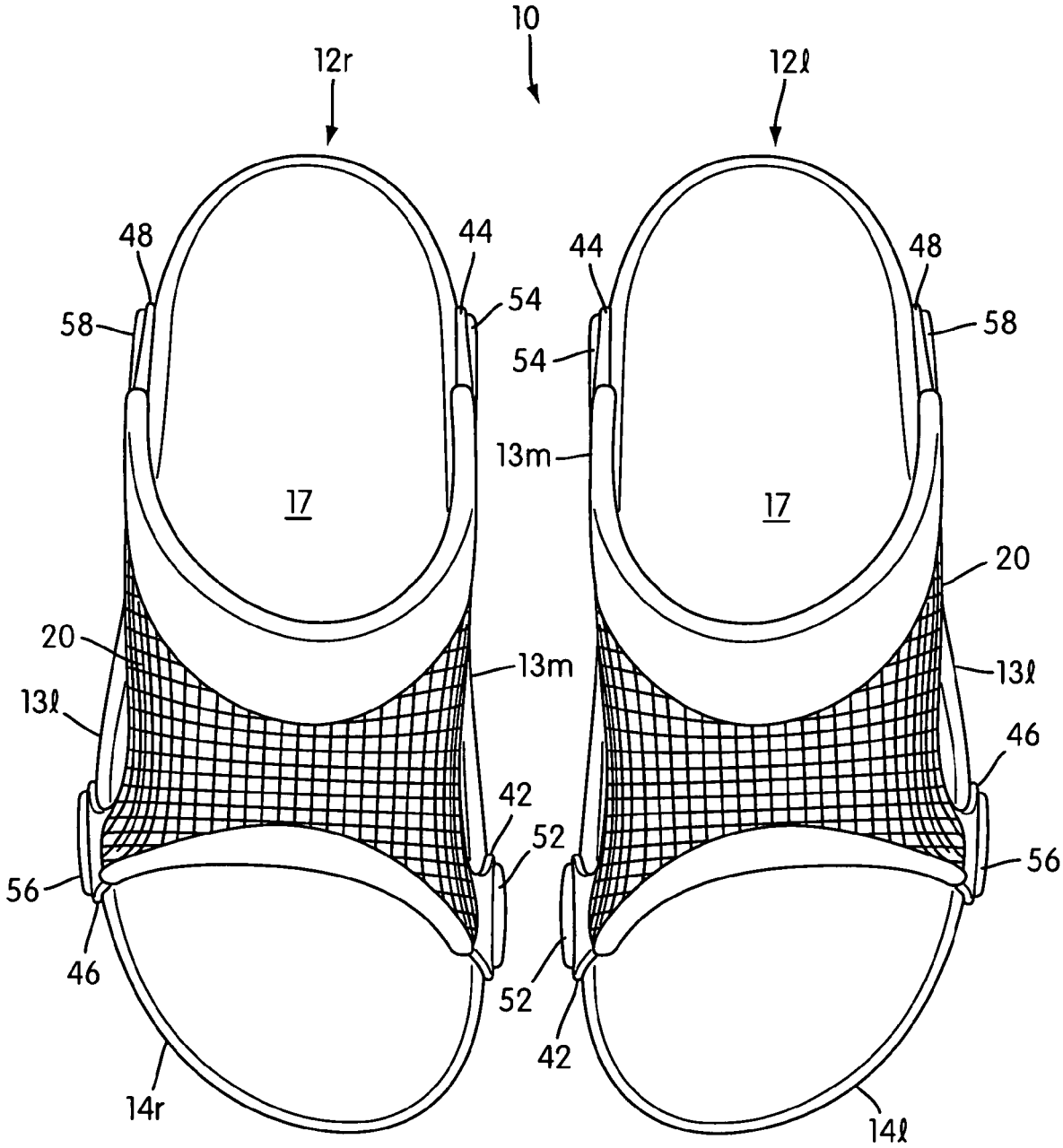
FIG. 4 is a top view of the pair of shoes of FIG. 1 with the upper portions being attached to the soles in a second configuration in accordance with the present invention.
Figure 5:
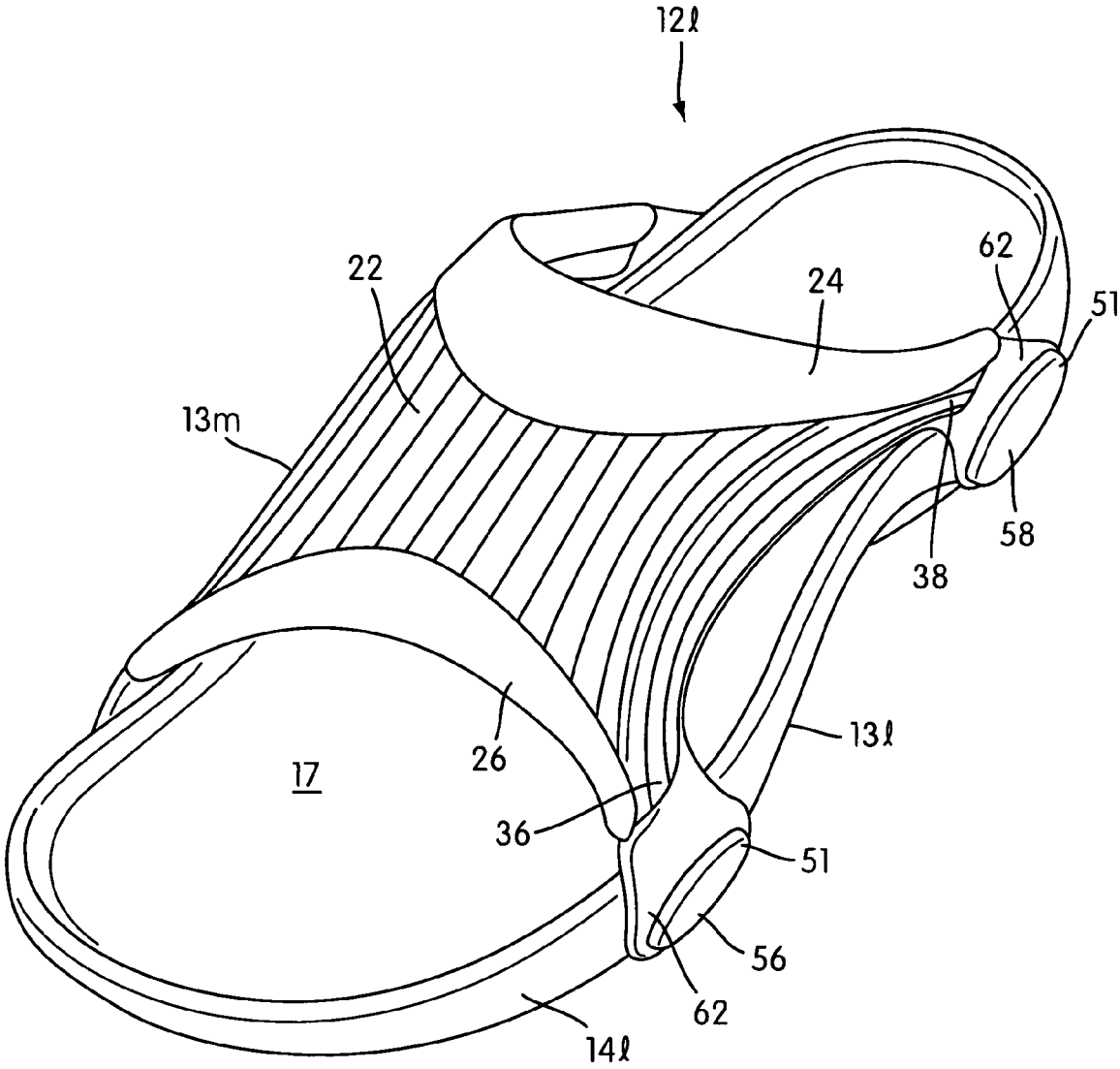
FIGS. 5 and 6 are front-lateral and front-medial perspective views of the shoe of FIG. 1 with the upper portion being attached to the sole in the first configuration.
Figure 6:
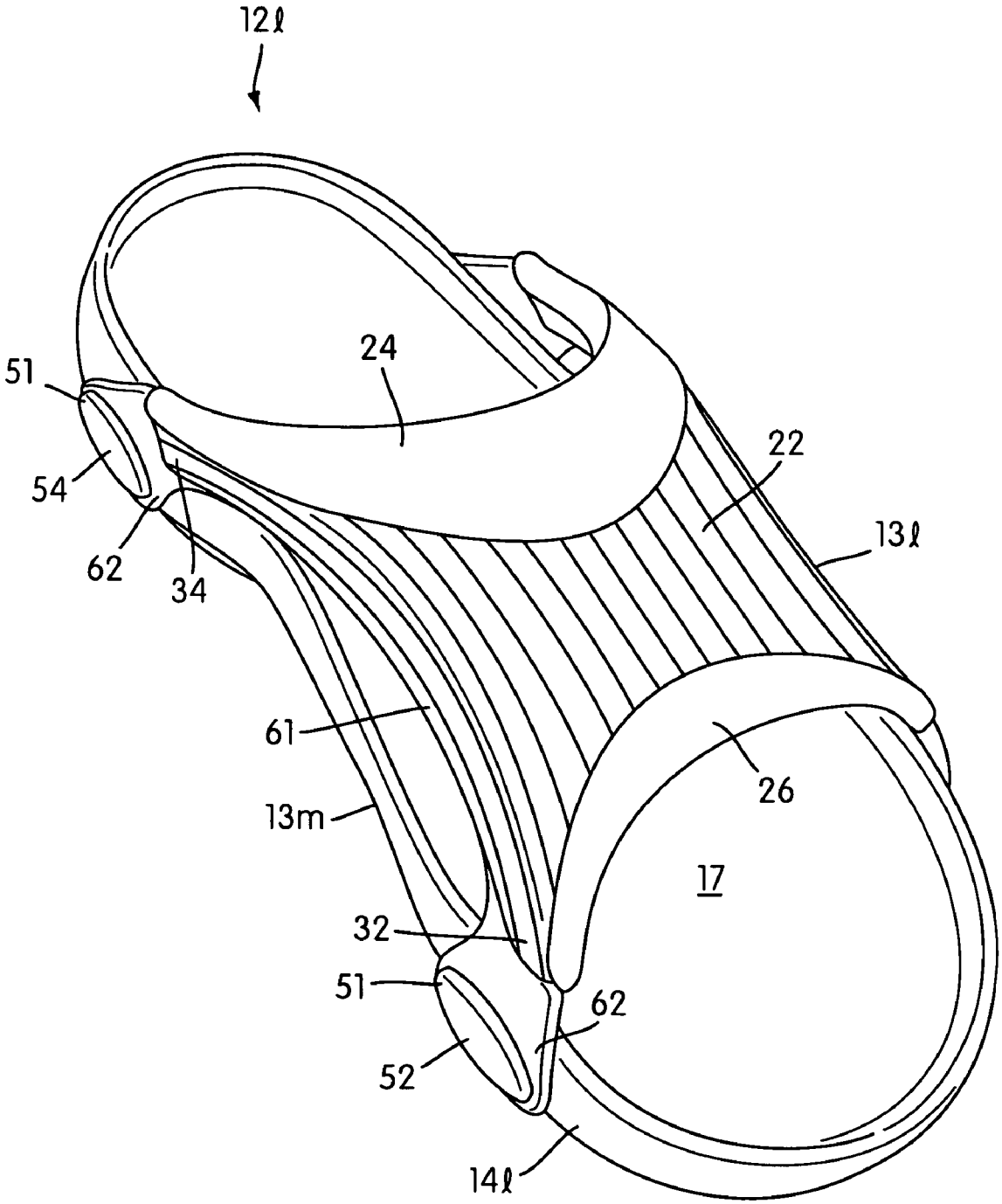

FIGS. 1–6 show an exemplary embodiment of a pair of articles of footwear generally designated with reference number 10 and referred to herein as a pair 10 of shoes 12. The shoes 12 are preferably, but need not be, sandals such as shown in the figures. The pair 10 of the shoes is shown in FIGS. 1 and 4 and includes a left shoe 12*l* and a right shoe 12*r*.

Each shoe 12*l* or 12*r* in the pair 10 includes a sole 14 and an upper 20. The sole 14 is intended to provide a wear resistant lower surface and preferably also a suitable amount of cushioning capabilities. The upper 20 holds the user's foot to the sole 14 and provides a fit for the user's foot. The upper 20 includes a back edge or otherwise open area to form a foot opening permitting the insertion of the user's foot into the shoe 12 and onto a footbed 17. In an exemplary arrangement where the shoe 10 is a sandal, as depicted, the removable upper 20 is a strap system. As will be evident from the following description, each upper/strap system 20 is removably coupled to each sole 14 by an upper-to-sole attachment system that enables the upper 20 to be reversible when transferred from one shoe in the pair (e.g., the left shoe 12*l*) to the other shoe in the pair (e.g., the right shoe 12*r*).

Figure 2:
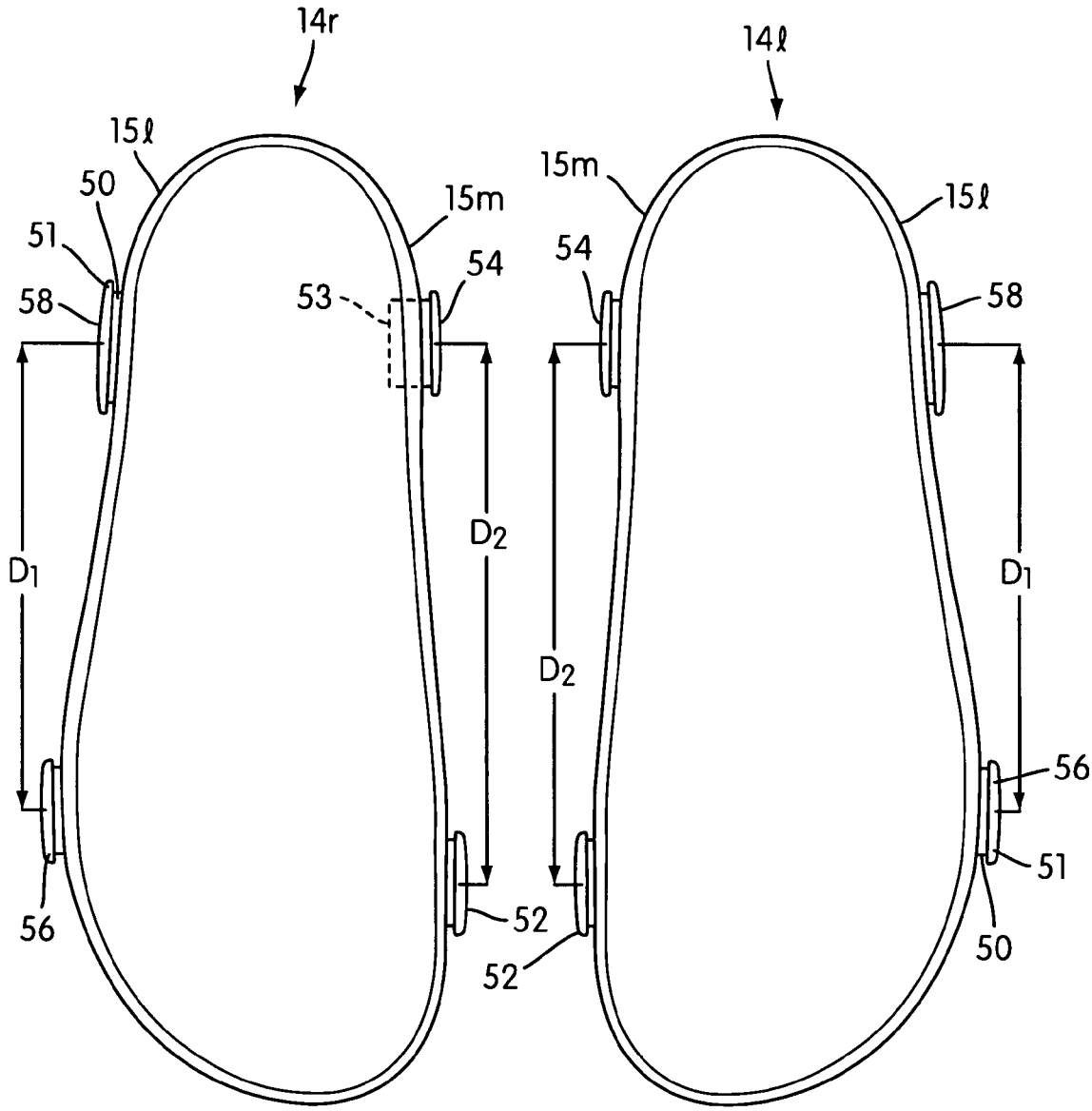
FIG. 2 is a top view of the pair of shoes of FIG. 1 with the upper portions being removed.

Additionally, each shoe 12, upper 20, and sole 14 includes a medial side and a lateral side. The medial side is the side that faces toward the centerline of the user's body when worn. The lateral side is the side that faces away from the centerline of the user's body when worn. The lateral side of each shoe is designated by reference numeral 13*l*, while the medial side of each shoe 12 is designated by reference numeral 13*m*. Also, as can be seen in FIG. 2, the lateral side of each sole 14 is designated by reference numeral 15*l*, while the medial side of each sole 14 is designated by reference numeral 15*m*. Similarly, the lateral side of each removable upper 20 is designated by reference numeral 21*l*, while the medial side of each removable upper 20 is designated by reference numeral 21*m*.

In an exemplary embodiment each sole 14 is formed of any conventional durable material to resist wearing during use, such as but not limited to, rubber and rubber compositions, including phylon. The soles 14 may be formed by a single unitary molded structure. Alternatively, each sole 14 may include a midsole material for cushioning and an outsole. If used, the composition of midsole may be of any desired structure or material, such as compression molded ethylene vinyl acetate (EVA), intended to provide cushioning for the user. Many variations of midsole structures that may be used in the present invention include but are not limited to full length molded designs and discrete portions of cushioning material. Further, if desired, the midsole can include one or more subcomponents such as gas, liquid, or fluid bladders encapsulated in midsole material, and/or vertical column structures. As described hereinafter, the sole 14 also includes coupling elements that form part of an upper-to-sole coupling system. In the depicted embodiment, each sole 14 includes a front medial coupling 52, a rear medial coupling 54, a front lateral coupling 56, and a rear lateral coupling 58.

Each upper 20 has two different presentable external surfaces, such as faces $\mathbf{22}_i$ and $\mathbf{22}_{ii}$ on a central body portion. Based on which sole 14*r* or 14*l* that upper is attached to, one of the faces $\mathbf{22}_i$ or $\mathbf{22}_{ii}$ will be exposed at a given time and the other of the faces $\mathbf{22}_i$ and $\mathbf{22}_{ii}$ will be facing inward toward the foot of the user. FIG. 3*a* shows the upper 20 in a first exposed orientation such that first external face $\mathbf{22}_i$ is exposed to provide a first appearance. FIG. 3*b* shows the upper 20 in a second exposed orientation, inverted from the first orientation, such that second external face $\mathbf{22}_{ii}$ is exposed to provide a second appearance. As can be understood, the first external face 22*i* and the second external face $\mathbf{22}_{ii}$ are on opposite sides of the upper. In an exemplary arrangement, as depicted, external faces $\mathbf{22}_i$ and $\mathbf{22}_{ii}$ have two different appearances. However, one alternative embodiment, not shown, includes the first external face $\mathbf{22}_i$ and the second external face $\mathbf{22}_{ii}$ having the same appearance.

The upper 20 may also include, as depicted, a rear trim 24 or covering and a front trim 26 or covering. If desired these sections 24 and 26 may be padded. These sections may serve to protect the main body portion 22 and add increased comfort to the pair of shoes 10. The material for the upper 20 is not critical to the invention. However, in one configuration, the upper 20 may be made partially or entirely of synthetic materials. For example, the front and rear trim sections 26 and 24 may be made of a synthetic leather material, and the central body region 22 may be made of a woven synthetic material and may include a synthetic coating if desired. However, it is recognized that many other materials may be used in lieu of those described herein.

The upper 20 also includes extension sections that serve as straps and also extend to a coupling device. These extensions may be part of the central body portion 22. In the depicted exemplary embodiment, there is a front medial extension 32, a rear medial extension 34, a front lateral extension 36, and a rear lateral extension 38. A coupling element 42, 44, 46, and 48 is located at or near the end of each respective extension 32, 34, 36, and 38. As described hereinafter, the coupling elements 42, 44, 46, and 48 of the upper 20 engagingly mate with the coupling elements 52, 54, 56, and 58 of the sole 14.

To enhance comfort, each upper 20 is not symmetric about a longitudinal center line of the shoe. That is, the uppers 20 are asymmetric. Specifically, they are longitudinally asymmetric in that the lateral and medial sides are not mirror images about a center line through the approximate center of the shoe. This enables the strap system 20 to better and more comfortably interface with the anatomy of the human foot to enhance the fit of the shoe 12. While the drawings depict a first exemplary asymmetric strap system 20, alternative asymmetric strap systems/uppers may be used in lieu of the depicted embodiment.

The upper-to-sole attachment system includes the removably mating or interfacing couplings on the upper 20 and on the sole 14. In the illustrated embodiment, the coupling includes an anchor on the sole 14 and a mating hole on the upper 20. More specifically, and as seen in FIG. 2, each anchor on the sole 14 includes an outwardly protruding body portion or shank 50 and an enlarged end section or shoulder 51 disposed on the distal end of the body portion 50. The anchor may be molded integrally with the sole 14 or a portion of the sole 14. Alternatively, the anchors may be molded separately and be provided with a plug portion 53 that is an extension of the body portion 50. This is schematically represented in the rear medial portion of the right sole 14*r* of FIG. 2. If the anchors are made separately, the sole 14 may include a channel sized complimentary to the plug portion 53 and the plug portion 53 may be inserted into and glued or otherwise fixed into the channel.

The mating coupling portion on the upper 20 includes a flange 60 that has a hole 62 therein. The hole is preferably shaped and sized to be slightly larger than, but substantially complimentary to, the body portion 50 of the anchor. The shoulder 51 is similarly shaped but slightly larger than the hole 62. The shoulder 51 is somewhat flexible to permit the hole 62 to be worked over the shoulder 51 and onto the body portion 50. Once positioned on the body portion 50, the flange 60 will remain coupled to the anchor during normal footwear usage until the flange is manually worked back over the flexible shoulder 51. It is recognized that other complimentary coupling arrangements may be used.

In the depicted embodiment, the upper-to-sole attachment system is a multiple point attachment system, and includes four attachment points wherein the strap system 20 and the sole 14 can be removably coupled. In the depicted arrangement, there is an attachment point at the front medial, rear medial, front lateral, and rear lateral portions of the shoe. Thus, this respectively corresponds to the coupling elements on the sole 52, 54, 56, and 58 and the coupling elements on the upper 42, 44, 46, and 48. It is recognized that more or less than four couplings may be used, and they need not be located in each quadrant of the shoe.

Since the upper 20 is asymmetric, it is helpful to prevent the user from placing the upper 20 on the sole upside-down or angularly displaced. The coupling system is preferably "keyed" to achieve this goal. By keyed, and in the depicted arrangement, it means at least one coupling for the upper 20 does not normally fit or mate with at least one coupling for the sole 14. Specifically this is achieved in the exemplary depicted embodiment by including two sets of differing couplings for the upper 20 and two sets of differing couplings for the sole 14. Thus, there are some couplings wherein they will not properly mate with one another. In one arrangement, as shown, one coupling will not fit the remaining coupling. While this can be achieved in different manners, such as having a different size and/or shape, the rear lateral couplings on the sole and on the upper depicted embodiment is differently (e.g., sized larger) than the other three couplings. This will ensure that the user places the upper 20 in one orientation on one sole and in the opposite exposed orientation when attached to the other sole.

The larger size also serves as a visual indicator so that a user is not likely to attempt to forcibly assembly and possibly break a coupling device while trying to attach an upper to a sole. A second indicator to minimize the likelihood of an incorrect installation is that the spacing between the couplings is different on the medial and lateral sides. Thus for example, the distance between the two couplings on the lateral side D1 may be smaller than the spacing on the medial side D2. This too will inherently aid the user in the proper assembly process.

As indicated above, the appearance of the upper 20 will preferably be different to give the user additional aesthetic flexibility in the use of the product. Thus, while the surfaces of 22*i* and 22*ii* are represented by a striped and a checkered pattern respectively, such representations are intended to depict generic different surfaces. For example, one exposed surface could be a solid color while the other surface could be a pattern. Thus, this would be helpful to wear the desired pattern based on the event/location and/or the clothes that the user is wearing. Alternatively, the exposed surfaces 22*i* and 22*ii* could be two different pastel colors and the user could install the uppers to best match the clothes that the user is wearing. Alternatively, one side could have a mascot or other indicia of a sports team where the opposing side could be a solid or pattern. If desired, both sides could be provided with the same pattern. This would provide the user with flexibility to change the appearance of the shoe if the shoe upper was worn, damaged, and/or blemished.

While the various features of shoe 12 work together to achieve the advantages previously described, it is recognized that individual features and sub-combinations of these features can be used to obtain some of the aforementioned advantages without the necessity to adopt all of these features. The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

What is claimed is:

1. A pair of shoes comprising:

a left sole;

a right sole;

first and second uppers each removably detachable from the left and right soles; and a keyed upper-to-sole coupling system for coupling the uppers to the soles such that the first upper can be coupled to the left sole in a first exposed orientation and coupled to the right sole in a second exposed orientation opposite from the first exposed orientation, and wherein the second upper can be coupled to the right sole in a first exposed orientation and coupled to the left sole in a second exposed orientation opposite from the first exposed orientation.

2. The pair of shoes of claim 1, wherein the keyed upper-to-sole coupling system includes mating coupling that have complimentary mating sections.

3. The pair of shoes of claim 1, wherein upper-to-sole coupling system includes a plurality of flanges with holes on each upper and a plurality of outwardly projecting anchors having body portions and distal shoulders on each sole, wherein the holes in the flanges are shaped substantially complimentary to body portions on respective anchors.

4. The pair of shoes of claim 3, wherein the pair of shoes is a pair of sandals and each of the first and second uppers have different external faces depending upon whether they are in the first exposed orientation or the second exposed orientation.

5. The pair of shoes of claim 4, wherein the first and second uppers each includes a lateral flange containing lateral front and lateral rear holes and a medial flange containing medial front and medial rear holes.

6. A removable upper system for removably coupling to a pair of soles, the upper system comprising:

first and second uppers each having a plurality of keyed coupling elements such that the first upper is attachable to a first sole only in a single exposed orientation and is attachable to the second sole only in a different exposed orientation, and the second upper is attachable to the second sole only in a single exposed orientation and is attachable to the first sole only in a different exposed orientation, wherein the keyed coupling elements are each at a distal end of a respective extension from the body region, wherein the keyed coupling elements include four coupling elements on each upper, elements on each upper includes a first coupling element in a front lateral region of each upper, a second coupling element in a rear lateral region of each upper, a third coupling element in a front medial region of upper, and a fourth coupling element in a rear medial region of each upper.

7. The removable upper system of claim 6, wherein each of the first and second uppers include first and second external faces, the first and second external faces of each of the first and second uppers having a body region that has a contrasting appearance when compared to the body region of the opposite side.

8. The removable upper system of claim 6, further comprising a lateral flange connecting the first and second coupling elements and a medial flange connecting the third and fourth coupling elements.

9. A pair of shoes comprising:

a left sole;

a right sole;

first and second reversible uppers removably detachable from the left and right soles, each of the first and second uppers being longitudinally asymmetric; and an upper-to-sole coupling system for coupling the first and second uppers to the left and right soles such that the first upper can be coupled to the left sole in a first exposed orientation and coupled to the right sole in a second exposed orientation opposite from the first exposed orientation, and wherein the second upper can be coupled to the right sole in a first exposed orientation and coupled to the left sole in a second exposed orientation opposite from the first exposed orientation, wherein the upper-to-sole coupling system includes a plurality of spaced upper-to-sole couplings for each shoe, each coupling having mating first and second portions, the mating portions being keyed such that the first upper is attachable to the left sole only in its first exposed orientation and is attachable to the right sole only in its second exposed orientation, and the second upper is attachable to the left sole only in its second exposed orientation and is attachable to the right sole only in its first exposed orientation.

10. The pair of shoes of claim 9, wherein the upper-to-sole couplings on each sole and upper are spaced relative to each other to achieve a desired angular orientation between the upper and the sole.

11. A pair of shoes comprising:

a left sole;

a right sole;

first and second reversible uppers removably detachable from the left and right soles, each of the first and second uppers being longitudinally asymmetric; and an upper-to-sole coupling system for coupling the first and second uppers to the left and right soles such that the first upper can be coupled to the left sole in a first exposed orientation and coupled to the right sole in a second exposed orientation opposite from the first exposed orientation, and wherein the second upper can be coupled to the right sole in a first exposed orientation and coupled to the left sole in a second exposed orientation opposite from the first exposed orientation, wherein the upper-to-sole coupling system includes a plurality of coupling elements on each upper, the coupling elements on each upper include at least one coupling of a first type and at least one coupling of a second type, different from the first type.

12. The pair of shoes of claim 11, wherein the first type coupling is larger than the second type coupling.

13. A pair of shoes comprising:

a left sole;

a right sole;

first and second reversible uppers removably detachable from the left and right soles, each of the first and second uppers being longitudinally asymmetric; and a keyed upper-to-sole coupling system for coupling the first and second uppers to the left and right soles such that the first upper can be coupled to the left sole in a first exposed orientation and coupled to the right sole in a second exposed orientation opposite from the first exposed orientation, and wherein the second upper can be coupled to the right sole in a first exposed orientation and coupled to the left sole in a second exposed orientation opposite from the first exposed orientation, wherein the pair of shoes is a pair of sandals and the upper-to-sole coupling system includes a plurality of flanges on each upper and a plurality of outwardly projecting anchors on each sole.

14. The article of footwear of claim 13, wherein the flanges include holes, and the anchors include body portions and distal shoulders, wherein the holes in the flanges are shaped substantially complimentary to body portions on respective anchors.

15. The article of footwear of claim 14, further comprising at least four anchors disposed on each sole, the four anchors include a first anchor in a front lateral region of each sole, a second anchor in a rear lateral region of each sole, a third anchor in a front medial region of each sole, and a fourth anchor in a rear medial region of each sole.

16. The article of footwear of claim 15, wherein the first and second uppers each includes a lateral flange containing lateral front and lateral rear holes and a medial flange containing medial front and medial rear holes.

* * * * *